US007434838B2

(12) United States Patent
Dix et al.

(10) Patent No.: US 7,434,838 B2
(45) Date of Patent: Oct. 14, 2008

(54) WORK VEHICLE STABILIZER

(75) Inventors: Peter J. Dix, Naperville, IL (US); Dennis J. Heyne, Burlington, IA (US)

(73) Assignee: CNH America LLC, New Holland, PA (US)

( * ) Notice: Subject to any disclaimer, the term of this patent is extended or adjusted under 35 U.S.C. 154(b) by 129 days.

(21) Appl. No.: 11/471,886

(22) Filed: Jun. 21, 2006

(65) Prior Publication Data

US 2006/0237958 A1 Oct. 26, 2006

(51) Int. Cl.
*B60S 9/10* (2006.01)

(52) U.S. Cl. ..... 280/764.1; 280/763.1; 700/85

(58) Field of Classification Search ..... 280/764.1, 280/763.1; 700/85, 17, 32, 33, 35, 56, 60, 700/75, 245, 264

See application file for complete search history.

(56) References Cited

U.S. PATENT DOCUMENTS

| | | | | |
|---|---|---|---|---|
| 3,912,288 | A | 10/1975 | F'Geppert | |
| 4,473,239 | A | 9/1984 | Smart | |
| 4,746,133 | A | 5/1988 | Hanser et al. | |
| 4,865,295 | A | 9/1989 | Holloway | |
| 5,176,391 | A | 1/1993 | Schneider et al. | |
| 5,188,379 | A | 2/1993 | Krause et al. | |
| 5,312,119 | A | 5/1994 | Schneider et al. | |
| 5,642,653 | A * | 7/1997 | Hutchison | 91/459 |
| 5,685,377 | A * | 11/1997 | Arstein et al. | 172/2 |
| 5,727,387 | A | 3/1998 | Hosseini et al. | |
| 5,913,525 | A | 6/1999 | Schneider et al. | |
| 5,996,342 | A * | 12/1999 | Khan et al. | 60/421 |
| 6,058,342 | A * | 5/2000 | Orbach et al. | 701/50 |
| 6,196,586 | B1 | 3/2001 | Messenger | |
| 6,481,749 | B2 | 11/2002 | Ahlers et al. | |
| 6,561,076 | B2 * | 5/2003 | Hou et al. | 91/443 |
| 6,584,385 | B1 | 6/2003 | Ford et al. | |
| 2002/0060450 | A1 | 5/2002 | Ahlers et al. | |
| 2003/0001373 | A1 | 1/2003 | Slater et al. | |

* cited by examiner

*Primary Examiner*—Christopher Ellis
*Assistant Examiner*—John D Walters
(74) *Attorney, Agent, or Firm*—Patrick M. Sheldrake; John William Stader; Michael G. Harms

(57) ABSTRACT

A system for automatically moving a stabilizer of a work vehicle is disclosed. A joystick is connected to an electronic controller, which in turn, is connected to valve drivers to drive stabilizer raising and lowering valves. In one mode of operation, the controller is programmed to move the stabilizers up or down at a rate that is proportional to the deflection of the joystick from a neutral position. If the operator holds the joystick in a certain position or range of positions, the controller enters a second mode in which it automatically raises the stabilizers even if the joystick is released. The stabilizer can be placed in a third mode of operation by moving the joystick rapidly back and forth. When the operator does this, the controller is configured to reduce the ramp rate or damping of its response to joystick movement.

14 Claims, 6 Drawing Sheets

WORK VEHICLE STABILIZER

FIELD OF THE INVENTION

The invention relates generally to work vehicles having stabilizers. More particularly, it relates to systems and methods for controlling the upward and downward motion of stabilizers.

BACKGROUND OF THE INVENTION

Work vehicles such as backhoes, cranes, and excavators often need to both travel over the ground and travel on roads in order to get to and from work sites. To travel over the road, they must be supported on wheeled suspensions and have a relatively narrow chassis. Yet to work effectively in the field they should have a wide base of support and be relatively rigidly connected to the ground to resist pitching, rolling and yawing.

Vehicles such as those named above are of particular concern since they have arms that reach far out away from the vehicle chassis to either carry loads or to dig into the ground with ground engaging tools such as pavement breakers or buckets. Without a solid supporting foundation, these outwardly reaching arms might overbalance the vehicle resting on its tires.

The historical method of providing both roadability and a solid foundation for working has been to add stabilizers that are slidingly or pivotally coupled to the chassis of the vehicle and extend outward therefrom to engage the ground. These stabilizers typically include an elongated member to which a broad ground-engaging pad is fixed at a free lower end thereof.

These stabilizers are commonly moved by actuators such as hydraulic cylinders that in turn are coupled to electrical, hydraulic or electro-hydraulic control circuits. The operator typically has a manual operator control or input device such as a switch, a lever or a joystick that he manipulates to extend or retract the cylinders, thereby lowering or raising the stabilizers.

When the operator manipulates the controls to lower the stabilizer, the stabilizer typically slides or pivots downward and outward until the stabilizer pad engages the ground. Once in this position, the operator can lower the stabilizer a little further, lifting the chassis of the vehicle slightly, raising it a bit off its wheels.

This transfers some of the weight of the vehicle to the stabilizers and converts the vehicle's chassis into a solid, fixed platform with a broader base of support than its wheels alone could provide.

Once in this stabilized position, the operator can manipulate the vehicle's attachments with confidence that the vehicle will not pitch, roll or tip.

In many operations the vehicle in question must be moved with some regularity. For example, backhoes are often used to clean ditches on the side of the road.

To do this cleaning, they are moved to a position facing the ditch. The stabilizers are then lowered to engage the ground. The operator then manipulates the backhoes' jointed arm (the boom, dipper and bucket) to scoop out material from the ditch.

After a few scoops, the operator stops digging, lifts the stabilizers, moves the backhoe forward and then backward to one side of his original position. He again lowers the stabilizers and again takes a few scoops with the vehicle's bucket.

The process may repeat perhaps 20-100 times in the course of a day as the backhoe gradually goes down the ditch alongside the road cleaning excess dirt from it.

The raising and lowering of the backhoe is time consuming during these operations. In current designs, the operator must keep his hands on the stabilizer lift and lower controls the entire time the stabilizers are being lifted and lowered. This is time that he could spend rotating his seat to a forward facing position, shifting the vehicle into a drive gear and moving the vehicle a few feet down the road. Furthermore, if he becomes careless with the repetitive stabilizer lifting and lowering, he may keep the stabilizer controls in the lift position too long. On some vehicles with stabilizers, holding the control in the lift position after the stabilizer is already raised can cause the vehicle's engine to stall.

What is needed, therefore, is a work vehicle having an improved stabilizer control circuit that can relieve the operator of the need to continually engage the controls the keep the stabilizers moving.

What is also needed is a system that can distinguish between an operators signal to raise or lower the stabilizer slightly and a signal to raise the stabilizer completely and automatically.

What is also needed is a system that can sense when the stabilizer is completely raised and responsively shut off the flow of fluid to and from the stabilizer hydraulic cylinders.

It is an object of this invention to provide one or more of the foregoing features and advantages in one or more of the embodiments claimed below.

SUMMARY OF THE INVENTION

In accordance with a first aspect of the invention, a system for automatically raising a stabilizer of a work vehicle is provided, including a proportional control operator input device configured to signal both a plurality of upward stabilizer raising rates and a plurality of stabilizer lowering rates; at least one electronic controller configured to receive a signal indicating a commanded raising rate and a commanded lowering rate from the input device; and at least one hydraulic valve coupled to the controller to raise and lower the stabilizer in response to rate signals received from the controller; wherein the controller has a first mode of operation in which it signals the at least one valve to raise and lower the stabilizer proportionate to the position of the input device, and further wherein the controller has a second mode of operation in which it automatically raises the stabilizer to a predetermined higher up position.

The controller may be configured to change from the first mode of operation to the second mode of operation based at least upon the operator's positioning of the input device. The controller may be configured to change from the first mode of operation to the second mode of operation based upon a period of time the input device is in at least one position of a range of positions. The controller may be configured to exit the second mode of operation when the stabilizer reaches the predetermined higher up position. The predetermined higher up position may be indicated by a hydraulic pressure spike. The controller may be configured to monitor a sensor responsive to the hydraulic pressure spike. The controller may be configured to leave the second mode of operation at least after a predetermined period of time by closing the at least one valve. The controller may be configured to leave the second mode of operation at least when the operator does not release the input device.

In accordance with a second aspect of the invention, a system for automatically raising a stabilizer of a work vehicle is provided, including an input device configured to generate signals indicating a plurality of stabilizer rates of movement; an electronic controller configured to receive the signals from the input device and generate corresponding valve signals; and at least one hydraulic valve coupled to the controller to move the stabilizer in response to the valve signals; wherein the controller has a first mode of operation in which it configured to signal the at least one hydraulic valve to raise and lower the stabilizer proportionate to the input device position, and further wherein the controller has a second mode of operation in which it automatically raises the stabilizer to a predetermined upper position. The controller may be configured to change from the first mode of operation to the second mode of operation based at least upon the operator's positioning of the input device. The controller may be configured to change from the first mode of operation to the second mode of operation based upon a period of time the input device is in any of several positions in a predetermined continuous range of positions, each of the several positions generating a different signal from the input device. The controller may be configured to exit the second mode of operation when the stabilizer reaches the predetermined upper position. The predetermined upper position may be indicated by a hydraulic pressure spike. The controller may be configured to monitor a sensor responsive to the hydraulic pressure spike. The controller may be configured to leave the second mode of operation at least after a predetermined period of time by closing the at least one valve. The controller may be configured to leave the second mode of operation at least when the operator does not release the input device. The system may further include a second input device configured to generate second signals indicating a plurality of stabilizer rates of movement for a second stabilizer; an electronic controller configured to receive the second signals from the second input device and generate corresponding second valve signals; and at least a second hydraulic valve coupled to the controller to move the second stabilizer in response to the second valve signals; wherein the controller is configured to control the stabilizer and the second stabilizer independently in the first and second modes of operation. The controller may be configured to damp stabilizer movement in the first mode of operation and the controller may be configured to enter a third, undamped proportional control mode of operation. The controller may be configured to enter the third mode by oscillating the input device. The controller may be configured to enter the third mode after a predetermined number of oscillations of the input device.

In accordance with a third aspect of the invention, a system for automatically moving a stabilizer of a work vehicle is provided, including an operator manipulable input device configured to generate signals indicating a plurality of stabilizer rates of movement an electronic controller configured to receive the signals from the input device and generate corresponding valve signals, and at least one hydraulic valve coupled to the controller to move the stabilizer in response to the valve signals, wherein the controller has a first mode of operation in which it is configured to signal the at least one hydraulic valve to raise and lower the stabilizer proportionate to the input device position at at least a first ramp rate, and further wherein the controller has a second mode of operation in which it raises and lowers the stabilizer proportionate to the input device position at at least a second ramp rate different from the first ramp rate.

The controller may be configured to automatically switch from the first ramp rate to the second ramp rate based at least upon a first movement of the operator input device. The controller may be configured to automatically switch from the second ramp rate to the first ramp rate based at least upon a second movement of the operator input device being of a magnitude than the magnitude of the first movement. The first movement may include (a) moving the operator input device above a first threshold position, and (b) moving the operator input device below a second threshold position. The operator input device may have a central position, and one of the first and second threshold positions may be on one side of the central position and the other of the first and second threshold position may be on the other side of the central position. The operator input device may be a joystick configured to generate joystick signals generally proportional to the positions of the joystick. The controller may be configured to change from the first to the second ramp rate when the operator moves the operator input device back and forth. The controller may be configured to change from the first to the second ramp rate when the operator moves the operator input device back and forth at least once within a predetermined time interval. Each movement of the operator input device may take no more than 800 milliseconds.

In accordance with a fourth aspect of the invention, a method of shaking a stabilizer controlled by a joystick is provided, including the steps of moving the joystick rapidly back and forth, electronically monitoring the rapid joystick back-and-forth movement, and reducing a stabilizer damping rate responsive to the monitored back and forth movement.

The step of electronically monitoring may include a step of determining a number of back-and-forth joystick movements. The step of electronically monitoring may include a step of determining an elapsed time of the back and forth movements. The step of electronically monitoring may include a step of determining a magnitude of the back and forth movements.

BRIEF DESCRIPTION OF THE FIGURES

Preferred exemplary embodiments of the present invention are illustrated in the accompanying drawings in which like reference numerals represent like parts throughout.

DETAILED DESCRIPTION OF THE PREFERRED EMBODIMENTS

Figure 1:
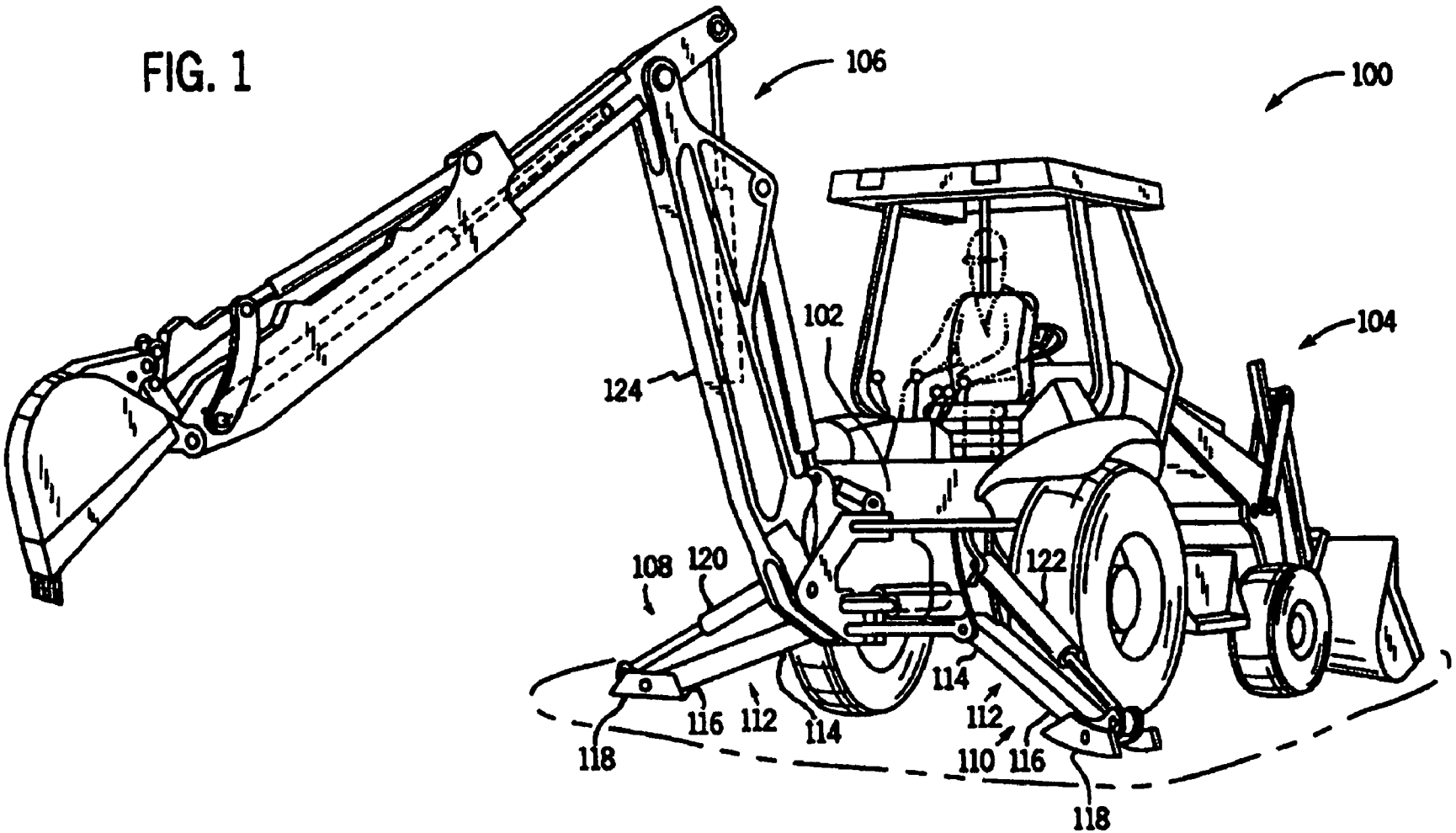
FIG. 1 is a rear view of a backhoe showing two stabilizers pivotally coupled to the vehicle chassis on either side of a rear operator's station. The stabilizers pivot about their upper ends where they are pivotally coupled to the chassis of the backhoe

In FIG. 1, a backhoe 100 has a chassis 102 on which an engine 104 is mounted. A backhoe attachment 106 extends backward from the rear of the chassis 102 to which it is pivotally coupled. A left stabilizer 108 and a right stabilizer 110 are pivotally coupled to the chassis 102 of the backhoe 100.

Each stabilizer has an elongate member 112 with an upper end 114 that is pivotally coupled to the chassis 102 and a lower end 116 that terminates at and is coupled to a stabilizer pad 118. In a preferred embodiment, the stabilizer pads have flattened bottoms that are disposed to sit flat on the ground when lowered. In another preferred embodiment the stabilizer pads 118 are pivotally coupled to ends 116 of stabilizers 108 and 110.

Hydraulic cylinder 120 is coupled at its upper end to chassis 102 and at its lower end to elongate member 112 of left stabilizer 108. Similarly, hydraulic cylinder 122 is coupled at its upper end to chassis 102 and at its lower end to elongate member 112 of right stabilizer 110.

When each hydraulic cylinder 120, 122 is extended, it pivots the stabilizer to which it is coupled downward and into engagement with the ground. When each hydraulic cylinder 120, 122 is retracted, it pivots the stabilizer to which it is coupled upward, away from the ground and to a stowed position for travel.

When the stabilizers are extended they touch the ground slightly behind the large rear tractor wheels of the backhoe on either side of the chassis where the backhoe boom 124 is coupled to the chassis 102.

Figure 2:
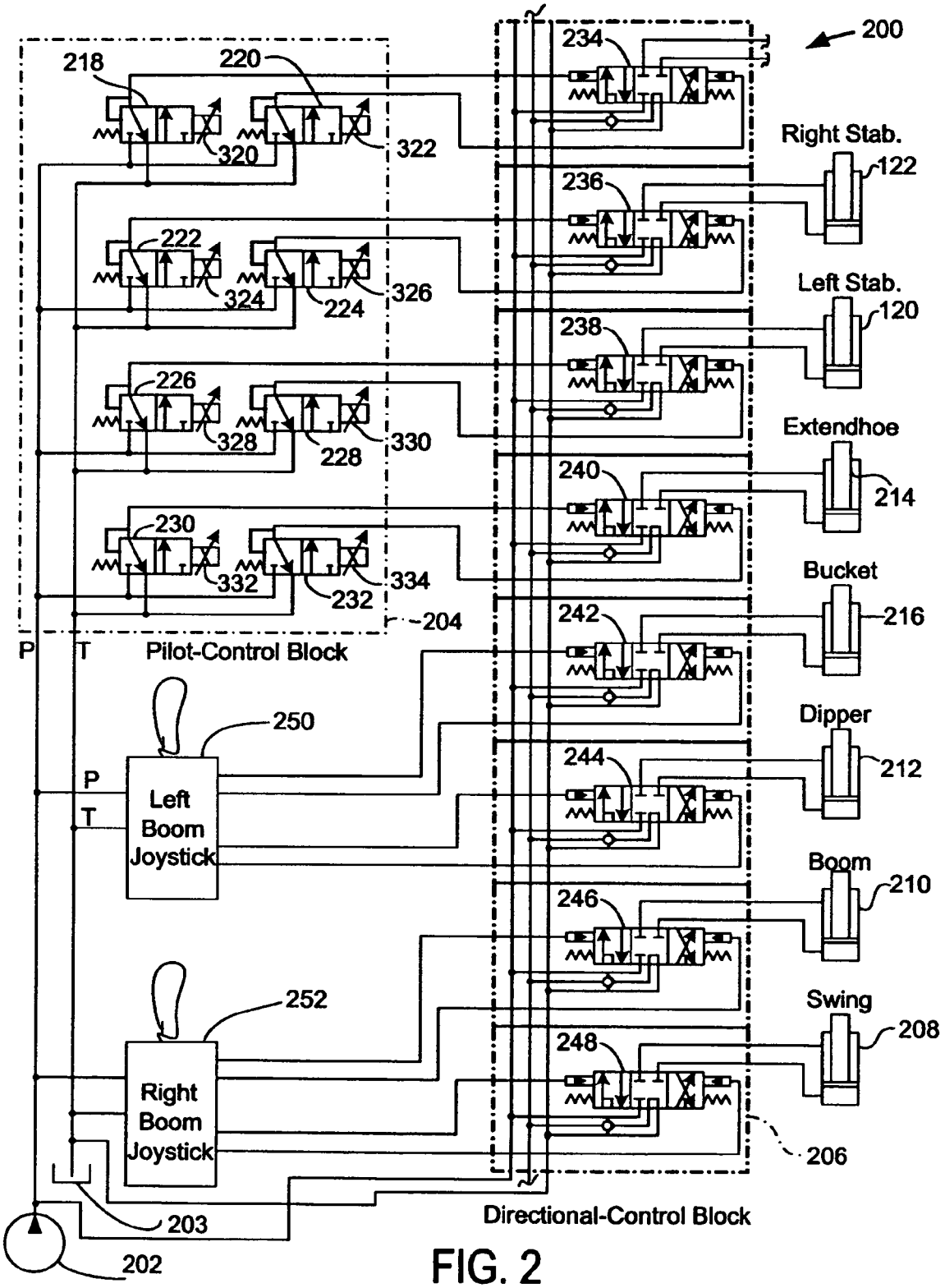
FIG. 2 is a schematic hydraulic diagram of the circuit of the vehicle of FIG. 1 that is used to position the stabilizers. The circuit includes the pilot and main directional control hydraulic valves for positioning the stabilizers, and the hydraulic cylinders that are coupled to the stabilizers to move them.

In FIG. 2, hydraulic circuit 200 for controlling the stabilizers includes a pump 202 that is coupled to and driven by engine 104 to produce hydraulic fluid under pressure for the backhoe arm and stabilizer cylinders. Circuit 200 also includes a hydraulic fluid return tank 203 to which hydraulic fluid exhausted from the cylinders is returned.

Pressure in the hydraulic lines coupled to the pump depends on the load, but can be as high as 3000 psig. When the stabilizers are completely raised and their cylinders stop retracting, the pressure in the hydraulic circuits connected to the cylinders will rise from about 2200 psig (while they are lifting) to about 3000 psig when they abut their stops and the stabilizers are completely raised. Pressure in the hydraulic lines coupled to tank 203 is around atmospheric pressure or zero psig.

Circuit 200 also includes two valve blocks, a pilot control valve block 204 that includes the electrically-actuated pilot valves for raising and lowering the stabilizers, and a directional control valve block 206 including the main hydraulic valves for raising and lowering the stabilizers, and for operating the backhoe arm, including the boom swing cylinder 208, the boom cylinder 210, the dipper cylinder 212, the extendahoe cylinder 214, and the bucket cylinder 216.

Pilot control valve block 204 includes an auxiliary forward pilot valve 218, and auxiliary reverse pilot valve 220, a right stabilizer up pilot valve 222, a right stabilizer down pilot valve 224, a left stabilizer up pilot valve 226, a left stabilizer down pilot valve 228, an extendahoe retract pilot valve 230 and an extendahoe extend pilot valve 232.

Directional control valve block 206 includes an auxiliary hydraulic valve 234, a right stabilizer valve 236, a left stabilizer valve 238, an extendahoe valve 240, a bucket valve 242, a dipper valve 244, a boom valve 246, and a boom swing valve 248.

Circuit 200 also includes two joysticks, a left joystick 250 and a right joystick 252 that are fluidly coupled to and operate the boom swing valve 248, the boom valve 246, the dipper valve 244 and the bucket valve 242.

Left joystick 250 includes hydraulic pilot valves that operate bucket valve 242 and dipper valve 244, which in turn are coupled to and drive bucket cylinder 216 and dipper cylinder 212, respectively.

Right joystick 252 includes hydraulic pilot valves that operate boom valve 246 and boom swing valve 248, which in turn are coupled to and operate boom cylinder 210 and boom swing cylinder 208, respectively.

These joysticks are configured to operate boom swing valve 248, boom valve 246, dipper valve 244, and bucket valve 242 that are located in the directional control valve block 206.

All of the pilot valves in the pilot control valve block 204 are electrically actuated spool valves. Each pilot valve in block 204 has a single valve coil or solenoid to shift the valve from its illustrated de-energized neutral position. Each of the pilot valves when in its neutral position conducts fluid from its associated directional control hydraulic valve to which it is coupled back to tank 203. When energized, each pilot valve conducts hydraulic fluid from pump 202 through the pilot valve to each directional control valve to which it is coupled.

All of the pilot valves in the pilot control valve block 204 are operated by a proportional electrical signal and generate an output pressure proportional to the electrical signal applied to them. The valves do have some hysteresis, which will be discussed below. The valves are preferably Thomas Magnete Proportional Pressure-Reduction valves, Thomas Magnete Part Number 52402. They have three ports and are pressure compensated. In general, these valves begin to "crack" or open with a current of 200 milliamperes at 12 volts and reach a maximum pressure with a current of 1.6 amperes at 12 volts. The pulse width modulated driver circuit that drives them (see the discussion of FIG. 3, below) has a frequency of between 100 and 120 Hertz.

The output pressure generated by the pilot valves is applied to either the left or the right end of the spool of the associated directional control hydraulic valve of block 206.

The force applied to the end of the valve spools of the directional control valves of block 206 is proportional to the hydraulic pressure applied. It is opposed by a spring acting on the opposing end of the valve spool.

The distance the valve spool in block 206 moves is proportional to the hydraulic pressure applied as well, since the spring opposing force is a function of distance deflected.

As a result, the spool position, and hence flow rate of fluid through each of the pilot-controlled hydraulic valves in block 206 is generally proportional to the electrical pulse width modulated ("PWM") signal applied to the pilot valve. By varying the magnitude of the PWM signal appled to the stabilizer pilot valves in block 204, we can directly vary the rate at which left and right stabilizer cylinders 120, 122 are retracted and extended.

When right stabilizer up pilot valve 222 is energized by its electrical coil, its spool shifts to the left, connecting hydraulic pump 202 to the left end of the spool of right stabilizer valve 236. This shifts the spool of right stabilizer valve 236 to the right from the position indicated. This movement connects pump 202 to the retract port of cylinder 122 causing right stabilizer cylinder 122 to retract. When right stabilizer cylinder 122 retracts, it lifts right stabilizer 110 upward away from the ground. Fluid from the extend port of right stabilizer cylinder 122 is automatically conducted back to tank 203.

When right stabilizer down pilot valve 224 is energized by its electrical coil, its spool shifts to the left, connecting hydraulic pump 202 to the right end of the spool of right stabilizer valve 236. This shifts the spool of right stabilizer valve 236 to the left from the position indicated. This movement connects pump 202 to the extend port of cylinder 122 causing right stabilizer cylinder 122 to extend. When right stabilizer cylinder 122 extends, it lowers right stabilizer 110 downward toward the ground. Fluid from the retract port of right stabilizer cylinder 122 is automatically conducted back to tank 203.

When left stabilizer up pilot valve 226 is energized by its electrical coil, its spool shifts to the left, connecting hydraulic pump 202 to the left end of the spool of left stabilizer valve 238. This shifts the spool of left stabilizer valve 238 to the right from the position indicated. This movement connects pump 202 to the retract port of cylinder 120 causing left stabilizer cylinder 120 to retract. When left stabilizer cylinder 120 retracts, it lifts left stabilizer 108 upward away from the ground. Fluid from the extend port of left stabilizer cylinder 120 is automatically conducted back to tank 203.

When left stabilizer down pilot valve 228 is energized by its electrical coil, its spool shifts to the left, connecting hydraulic pump 202 to the right end of the spool of left stabilizer valve 238. This shifts the spool of left stabilizer valve 238 to the left from the position indicated. This movement connects pump 202 to the extend port of cylinder 120 causing left stabilizer cylinder 120 to extend. When left stabilizer cylinder 120 extends, it lowers left stabilizer 108 downward toward the ground. Fluid from the retract port of left stabilizer cylinder 120 is automatically conducted back to tank 203.

Figure 3:
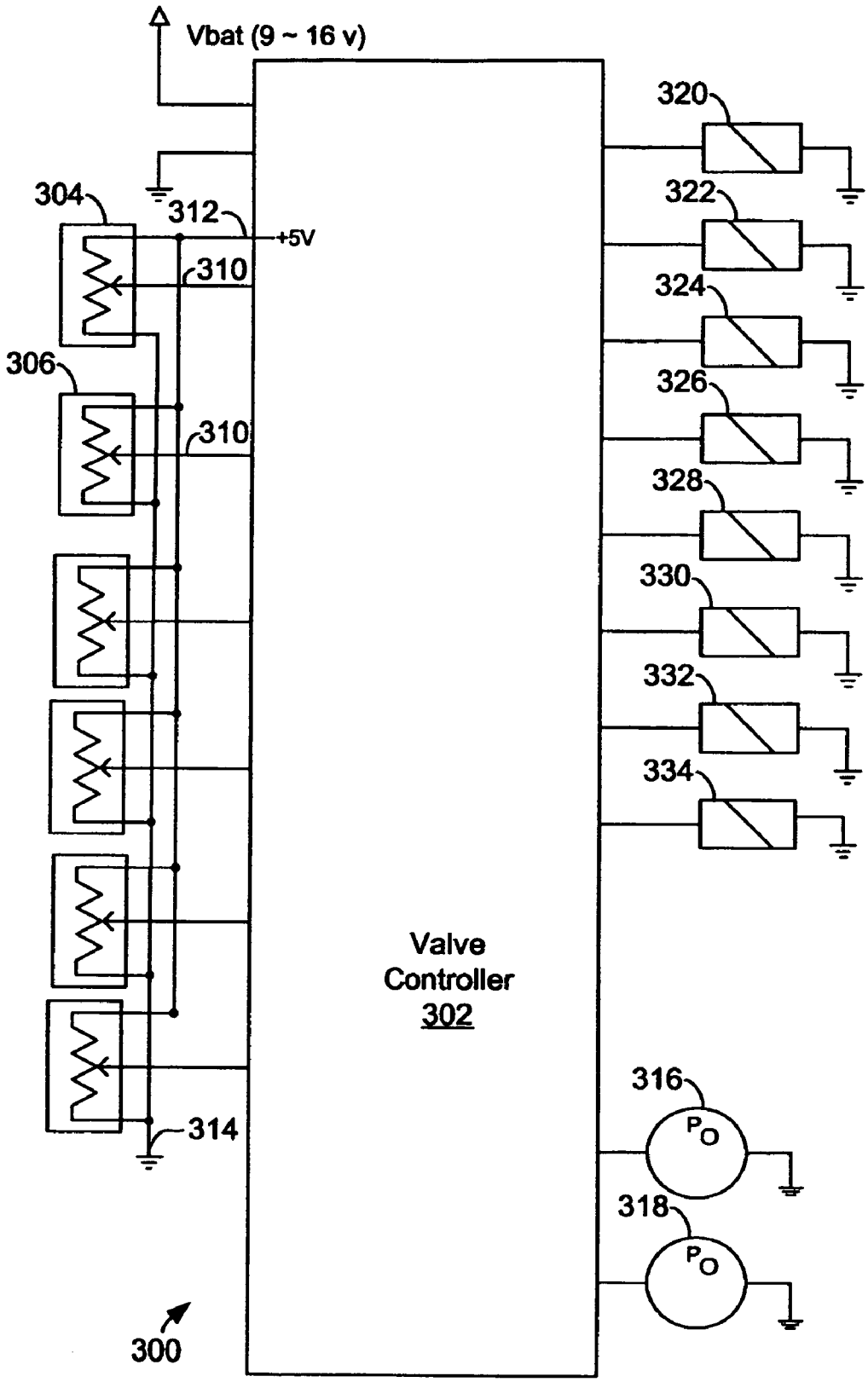
FIG. 3 is a schematic diagram showing the electronic controller circuit that is programmed to monitor and control the hydraulic circuit of FIG. 2.

FIG. 3 illustrates the electronic control circuit 300 for the backhoe of FIGS. 1 and 2. The core of the circuit is an electronic valve controller 302 including a digital programmable microprocessor, that is configured to receive operator commands from several operator input devices and generate responsive electrical signals that are applied to solenoids 320, 322, 324, 326, 328, 330, 332, and 334 of pilot valves 218, 220, 222, 224, 226, 228, 230, and 232 respectively. The electrical solenoids of these pilot valves are electrically coupled to and driven by valve controller 302 under program control.

Control circuit 300 of FIG. 3 includes two joysticks 304, 306 that are manually operated by the operator of the vehicle to move the stabilizers up and down. Left stabilizer joystick 304 and right stabilizer joystick 306 are electrically coupled to valve controller 302 to provide it with a varying voltage signal indicating the amount the joysticks are deflected away from a neutral central position.

The joysticks are preferably Elobau joysticks (Elobau part number J3A6AS0A01) with a voltage output of between 0.5 volts and 4.5 volts from one end of joystick travel to the other. While the joysticks are preferably Hall Effect devices, they are shown symbolically in FIG. 3 as variable resistors with a center tap 310 that provides the 0.5 to 4.5 volt signal to valve controller 302. Each joystick 304, 306 is electrically coupled on one side to five volt source 312 provided by valve controller 302 and at the other side to ground 314.

When the joysticks are manipulated by the operator, they move from one limit to another limit, generating a voltage signal at the center tap 310 that varies from 0.5 volts to 4.5 volts depending upon the position of the joystick. It is this 0.5 to 4.5 volt signal that indicates to valve controller 302 the position of the joystick. The voltage output in the center or neutral position of each joystick is 2.5 volts. The neutral position is the position located at the middle of the full range of joystick travel as illustrated in FIG. 3.

Valve controller 302 preferably includes a digital microcontroller with RAM and ROM, ideally flash ROM. The valve controller is preferably reprogrammable with a special tool to make manufacturing and rework easier. The digital microcontroller is preferably an 8-bit microcontroller with on-board flash memory, and analog-to-digital converter (for digitizing the signals generated by the joysticks) and PWM timers (for generating the PWM pilot valve solenoid signals from a calculated duty cycle). A preferred microcontroller for valve controller 302 is a PIC 16F873.

There are two pressure switches 316 and 318 that are coupled to valve controller 302. Pressure switch 316 is coupled to the hydraulic line extending from right stabilizer valve 236 to the rod end (the retract port) of right stabilizer cylinder 122. Pressure switch 318 is coupled to the hydraulic line extending from left stabilizer valve 238 to the rod end (the retract port) of left stabilizer cylinder 120. The pressure switches are in fluid communication with these hydraulic lines to sense the rod end pressure when the stabilizers are raised.

When the stabilizer cylinders are raised, they eventually reach their uppermost positions. During the period they are rising their rod end pressure is low. The system pressure is throttled by the stabilizer valves to insure the stabilizers rise at a relatively slow rate. As a result, the cylinder pressure is that pressure sufficient to support and slowly raise the stabilizers, on the order of a few hundred pounds per square inch.

Eventually the stabilizers reach their uppermost position, the position where they abut mechanical stops to prevent further upward motion. Since further motion is no longer permitted, the pressure in the stabilizer cylinders rapidly rises to the system pressure provided by the pump jumping suddenly to 3000 psig. At these pressures, pressure switches 316, 318 change state. They are set to change state well above working (i.e. stabilizer lifting) pressure and well below static (i.e. system), or in the preferred arrangement illustrated here, 2750 psig. In its auto-up modes of operation, it is the pressure switch changing state that informs the electronic controller of the system that the stabilizers have been completely raised.

Controller 302 of control circuit 300 is coupled to and drives the pilot valve electrical solenoids of each of the pilot valves in FIG. 2. These solenoids include solenoid 320 of auxiliary forward pilot valve 218, solenoid 322 of auxiliary reverse pilot valve 220, solenoid 324 of right stabilizer up pilot valve 222, solenoid 326 of right stabilizer down pilot valve 224, solenoid 328 of left stabilizer up pilot valve 226, solenoid 330 of left stabilizer down pilot valve 228, solenoid 332 of extendahoe retract pilot valve 230, and solenoid 334 of extendahoe extend pilot valve 232.

Each of these pilot valve solenoids are operated by PWM signals generated by eight PWM driver circuits in controller 302. The solenoids and their connections to the PWM driver circuits of controller 302 are shown in FIG. 3.

Figure 4:
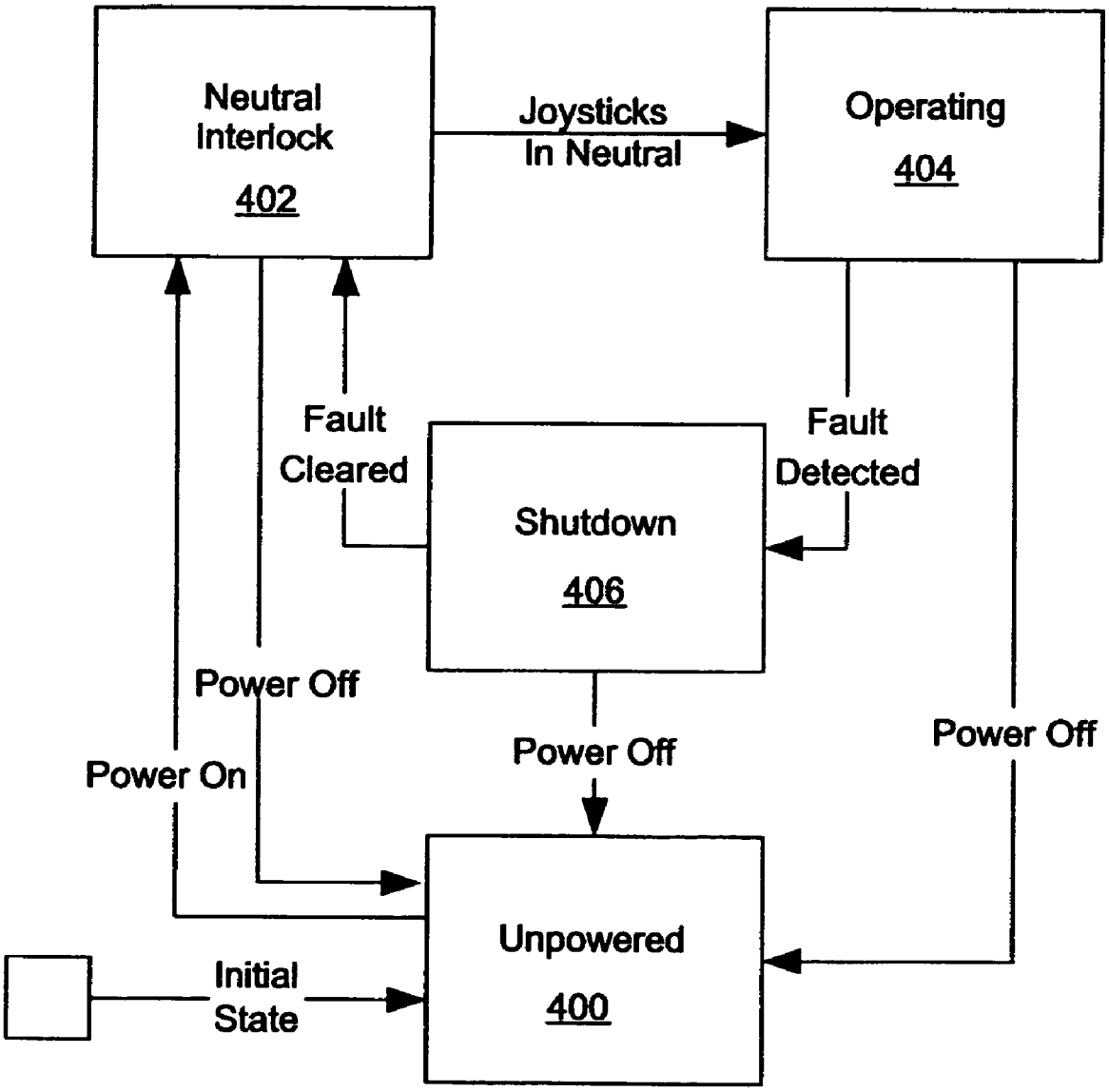
FIG. 4 is a state diagram of the modes of operation of the electronic controller showing the top level modes and the transitions between them.

Controller 302 is programmed to respond to the manipulation of stabilizer joysticks 304 and 306 differently in several different modes of operation. The top level modes of operation are called (1) the unpowered mode, (2) the neutral interlock mode, (3) the operating mode, and (4) the shutdown mode. These modes of operation are illustrated in the controller state diagram of FIG. 4.

The system is in the unpowered mode 400 whenever the vehicle's ignition switch is turned off or controller 302 is otherwise unpowered. Motion cannot occur when controller 302 is unpowered.

On power up (i.e. whenever controller 302 is initially powered up), controller 302 is programmed to leave the unpowered mode 400 and enter its neutral interlock mode of operation 402. In this mode, controller 302 does not respond to joystick commands by moving the stabilizers. Instead, it ignores any deflection of the joysticks away from their neutral position and polls a transmission neutral switch (not shown) and the stabilizer joysticks until both the transmission is placed in neutral and the joysticks are returned to their neutral positions.

Once both the stabilizer joysticks are in their neutral positions and the transmission is placed in neutral, controller 302 is programmed to leave the neutral interlock mode 402, and automatically enter its operating mode 404.

Once in the operating mode, the joysticks operate the stabilizers (as described in greater detail below) with regard to the multiple sub-modes of the operating mode. Controller 302 may transition from its operating mode 404 to a shutdown mode 406 under certain conditions. Controller 302 is programmed to periodically and repeatedly check the operation of the stabilizers by performing a suite of programmed diagnostic tests. Whenever any of these diagnostic tests are failed (i.e. there is a fault), controller 302 enters the shutdown mode of operation. In the shutdown mode of operation, controller 302 ceases to respond to the joysticks as it does in the operating mode (described below) and waits for the error condition or fault to be cleared.

Controller 302 periodically executes its programmed diagnostic tests in the shutdown mode 406 until either (1) the vehicle is powered down, or (2) the fault is cleared. If the fault is cleared, controller 302 is programmed to enter its neutral interlock mode 402. If the vehicle is powered down, controller 302 again enters the unpowered mode 400.

Figure 5:
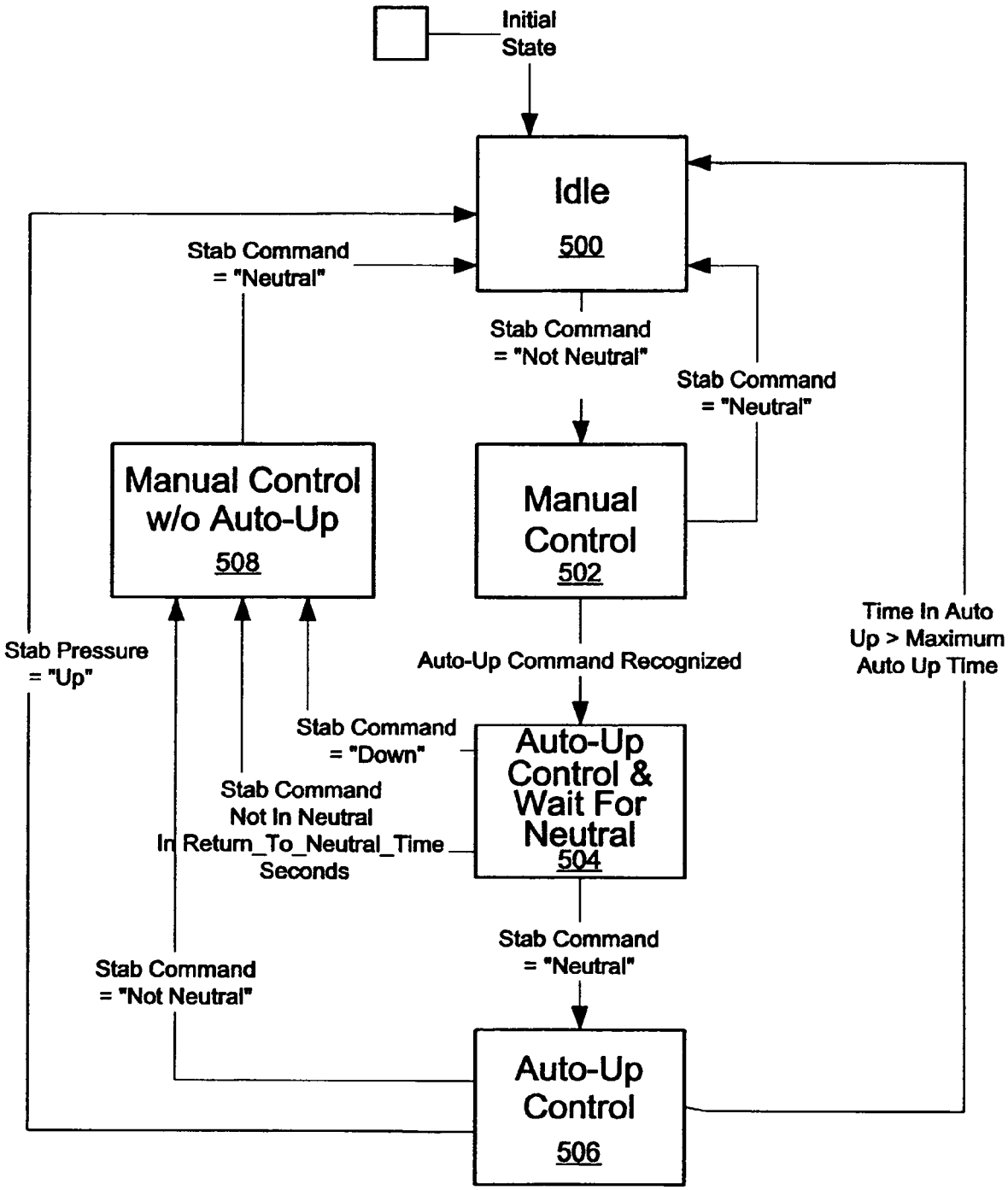
FIG. 5 is a state diagram of the sub-modes of the operating mode of FIG. 4 showing the sub-modes and the transitions between those sub-modes.

FIG. 5 is a state diagram indicating the different sub-modes of the operating mode 404. In operating mode 404, there are five sub-modes, including an idle mode 500, a manual mode 502, an auto-up control and wait for neutral ("ACWFN") mode 504, an auto-up control mode 506, and a manual control without auto-up ("MCWAU") mode 508.

The first of these modes is idle mode 500. Controller 302 enters the idle mode 500 immediately upon entering the operating mode 404 (of which the idle mode 500 is a sub-mode). Controller 302 is programmed to stay in the idle mode until a system fault occurs (at which time it enters shutdown mode 406), or the operator moves either one or both of the joysticks 304, 306 away from their neutral center position. Controller 302 enters the idle mode only when the stabilizer joysticks 304, 306 are in neutral. Whenever controller 302 is in the idle mode, it turns off the stabilizer pilot valves by transmitting a PWM valve signal with a duration of 0% to the stabilizer pilot valve solenoids which de-energizes them. The stabilizer cylinders cease moving.

The second operating sub-mode is manual control mode 502. Controller 302 enters the manual control mode from idle mode 500 whenever the operator moves either stabilizer joystick 304, 306 away from its neutral position.

In manual mode 502, controller 302 responds to movement of stabilizer joysticks 304, 306 in a programmed fashion to move the stabilizers up and down, depending upon the direction and amount joysticks 304, 306 are moved, which we will now describe.

Before we describe the operation of the left and right joysticks 304, 306 and stabilizers in the manual mode, however, be aware that both joysticks operate exactly the same but independently of each other. For that reason, in the description below we refer only to "the" joystick, PWM driver, pilot valve, solenoid, stabilizer valve, cylinder, and stabilizer. We do not separately describe the operation of the left and right stabilizer. The description below describes the operation of both the left and right stabilizers.

Once the operator moves the joystick away from its neutral position controller 302 enters the manual mode 502. In the manual mode, the operator commands the joysticks in either the upward or in the downward direction. The joysticks are preferably mounted with the left joystick on the operator's left hand side, and the right joystick on the operator's right hand side.

When the operator moves the joystick in one direction from neutral the voltage from the joystick increases from its nominal neutral voltage of 2.5 volts upward toward its high voltage of 4.5 volts. Controller 302 is programmed to interpret this movement as a "raise" or "up" command and begins to raise the stabilizer.

When the operator moves the joystick in the other direction from neutral the voltage generated by the joystick is lowered from the neutral voltage of 2.5 volts downward toward 0.5 volts. Controller 302 is programmed to interpret this movement as a "lower" or "down" command and lowers the stabilizer accordingly.

Controller 302 receives the voltage signal from the joystick and converts it into a duty cycle percentage, which it then applies to its internal PWM driver circuit for the pilot valve. Controller 302 includes two lookup tables of duty cycle versus joystick position which it uses to determine the appropriate PWM duty cycle. These lookup tables are graphically illustrated in FIG. 6.

Figure 6:
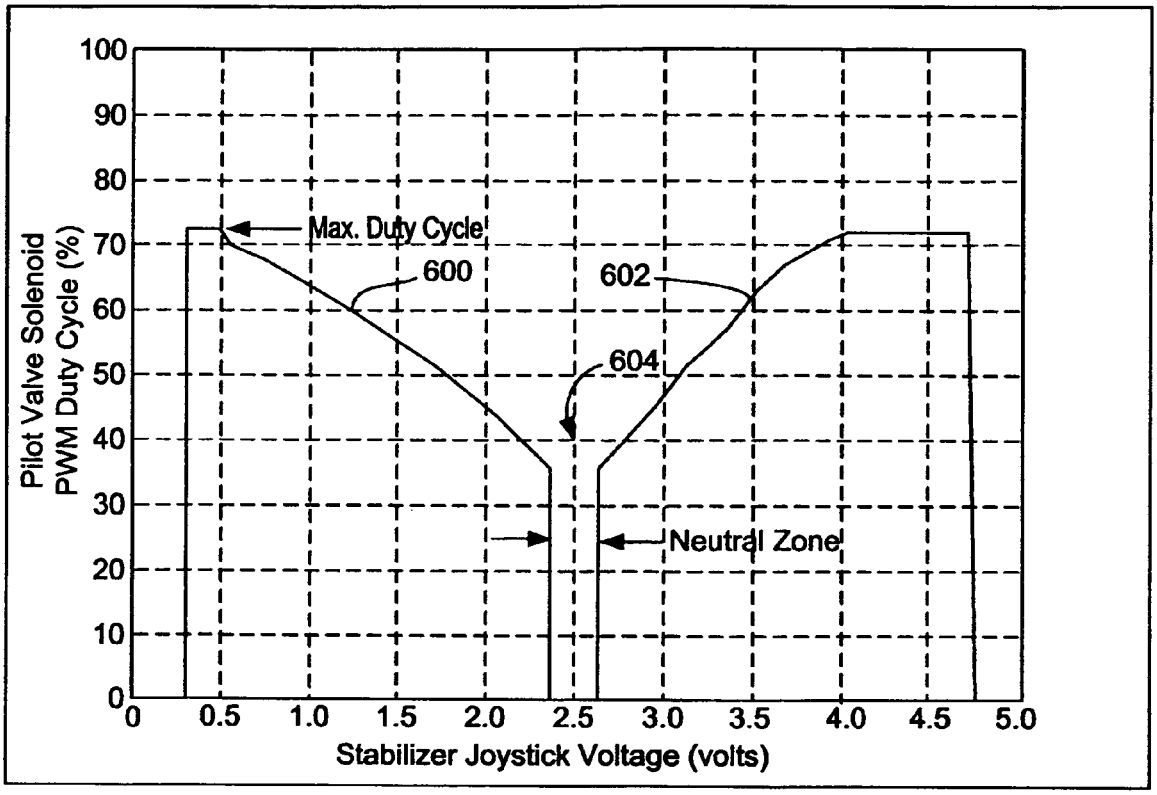
FIG. 6 is a graphical representation of the lookup tables accessed by the electronic controller to convert signals from proportional control operator input devices that indicate operator stabilizer commands into duty cycles of current controlled stabilizer pilot valves.

In FIG. 6, the "lower" or "down" lookup table used when the joystick is deflected to its "down" position to lower the stabilizer is represented as curve 600. The "raise" or "up" lookup table is represented as curve 602. The neutral position is indicated by item 604. The x-axis indicates the voltage signal generated by the joystick. The y-axis indicates the duty cycle (in percent) that controller 302 commands in response to receiving the joystick signal on the x-axis.

When the operator moves the joystick to the left (in FIG. 6) he is moving it in the "down" direction, causing controller 302 to use the lookup table of curve 600 to drive the stabilizer down pilot valve solenoid the duty cycle percentage indicated on the y-axis.

When the operator moves the joystick to the right (in FIG. 6) he is moving it in the "up" direction causing controller 302 to use the lookup table of curve 602 to drive the stabilizer up pilot valve solenoid with the duty cycle percentage indicated on the y-axis. The curves do not overlap, hence only one pilot valve solenoid, either the up solenoid or the down solenoid, is driven at any time. When the joystick is in the center, neutral zone of positions 604 (i.e. generating voltages of between about 2.3 and 2.7 volts) controller 302 is programmed to drive neither the up nor the down pilot valve solenoids and the stabilizer is stationary.

The down and up lookup tables 600, 602 are not identical, as shown in FIG. 6. Both curves start with a PWM duty cycle of about 35%, which is calculated to generate a current in the up and down solenoids sufficient to just crack the solenoid valves open. Both curves also have the same maximum PWM duty cycle of about 72%. At this duty cycle the stabilizers travel at their maximum speed, both up and down.

The slope of the lookup table curves is different, however. As shown in FIG. 6, the joystick has a higher resolution when moving the stabilizer down. It can be moved over a greater distance when it goes from a just-cracked condition to a full flow condition. This increased resolution gives the operator finer control of the movement of the stabilizer when it is being lowered than when it is being raised.

The joystick has a lower resolution when raising the stabilizer, as shown by the steeper slope of the up curve 602. The joystick is moved over a shorter distance to go from its just-cracked condition (i.e. the stabilizer barely moves) to a full flow condition (i.e. the stabilizer moves at its fastest speed) in the up direction as compared to movement in the down direction.

There is a second difference between the two lookup tables as represented by curves 600 and 602 in FIG. 6, and that is the horizontal flattened portion of the up curve 602 when the joystick is in positions that generate voltages of between 4.0 and 4.5 volts. The 4.0 volt position is called the "overpressure point" and is described below with regard to the auto-up features of the system.

To the operator, moving the joystick into the region between 4.0 and 4.5 volts has a distinctive "feel". Whenever, the joystick is in this range of positions above the overpressure point, controller 302 does not change the PWM duty cycle proportional to the changing joystick position. Instead, it holds the PWM duty cycle constant at its maximum rate (i.e. about 70%). The operator senses that he has reached an upper limit of movement and that further movement of the joystick will not cause the stabilizer to rise faster, which is true.

Referring back to FIG. 5, there are two ways controller 302 exits manual control mode 502. First, when the operator returns the joystick to the neutral or center position, and second, when the operator signals that he wishes to enter the auto-up control and wait for neutral (ACWFN) mode 504. Controller 302 is configured to continuously and repeatedly sense the position of the joystick and recalculate the PWM signal when in manual control mode 502. Controller 302 is also configured to sense how long the joystick is held in a stabilizer-raising position above a predetermined joystick position (i.e. at or above a predetermined joystick voltage output). Controller 302 enters ACWFN mode 504 whenever the operator holds the joystick in a stabilizer-raising position that generates a voltage of 4.0 volts or more for a predetermined period of time. The preferred predetermined period of time is at least 0.1 seconds. Holding the joystick in the predetermined position for the predetermined period of time constitutes the auto-up command. Once controller 302 senses that the joystick has been held in this position for this minimum time period, it automatically enters the ACWFN mode 504.

Once in ACWFN mode 504, controller 302 no longer calculates the up pilot valve solenoid duty cycle based on joystick position. Instead, it continues to apply the maximum duty cycle (about 70%) to the up pilot valve solenoid.

As a result, the operator need not hold the joystick in an "up" position to keep raising the stabilizer. He can release the joystick, let it return to its neutral position, and the stabilizer will continue to rise at its maximum rate.

"Auto-up" as used herein, refers to the system's ability to keep raising the stabilizer even after the operator has released the proportional control device that normal controls the stabilizer.

There are several ways that controller 302 is programmed to leave ACWFN sub-mode 504. The first way is by not releasing the joystick to the neutral position Once the operator has entered ACWFN mode 504, controller 302 waits for the joystick to be returned to neutral (hence the name). Controller 302 monitors the joystick position (i.e. the joystick voltage) for a predetermined period of time, preferably within 1 to 4 seconds, more preferably, between 1.25 and 3 seconds, and even more preferably about 2 seconds. If the joystick does not return to neutral (e.g. by the operator releasing the spring-loaded joystick 304, 306) during this period of time controller 302 then enters manual control without auto-up (MCWAU) mode 508.

Another way that the controller exits ACWFN mode 504 is by the joystick being moved to any stabilizer down position. A "stabilizer down" joystick position is any of the joystick positions representing a command to lower the stabilizer. In this embodiment, that means the joystick positions that generate a voltage of 2.3 volts or less. See FIG. 6. When this condition occurs, the operator is assumed to have taken control of the joystick and to be now commanding controller 302 to lower the stabilizer, or at least to immediately stop the auto-up. Controller 302 is programmed to leave the ACWFN mode 504 and enter MCWAU mode 508.

On the other hand, if the operator does release the joystick within the predetermined time interval without moving the joystick to any of the "down" positions, controller 302 leaves ACWFN mode 504 and enters Auto-Up Control mode 506.

In auto-up control mode 506, controller 302 continues to raise the stabilizer at its maximum duty cycle (70%, in this example). In auto-up control mode 506, controller 302 monitors the position of the joystick to insure the operator is not commanding the stabilizer to move to any other position.

If the operator does move the joystick away from its neutral position in the auto-up control mode 506 either to a joystick up position or to a joystick down position, controller 302 is programmed to automatically exit auto-up control mode 506 and enter MCWAU mode 508.

Controller 302 is configured to automatically leave the auto-up control mode 506 without operator intervention when two other conditions occur (1) when the stabilizer is raised completely and (2) when the stabilizer has been in auto-up mode for a predetermined number of seconds, whichever comes first.

It has been calculated for the preferred embodiment shown here that the stabilizer will be raised completely within ten seconds of starting the auto-up process if the system is working properly. Hence controller 302 monitors the time in the auto-up mode. When the time in auto-up control mode is eventually greater than the predetermined number of seconds in auto-up, controller 302 exits the auto-up control mode and enters the idle mode. While ten seconds is preferred, alternative embodiments may use a time interval of between 3 seconds and 20 seconds, more preferably between 4 seconds and 15 seconds, and even more preferably between 6 seconds and 12 seconds.

The final way of exiting the auto-up control mode 506 is by monitoring the stabilizer cylinder and exiting mode 506 when the stabilizer is completely raised. In this case, controller 302 determines that the stabilizer has been completely raised when the pressure switch 316, 318 coupled to controller 302 switches "on". The pressure switch is in fluid communication with the retract line of the stabilizer cylinder. As long as the cylinder is retracting, the pressure in the cylinder stays below the switch pressure. When the cylinder is completely retracted, abuts its stops and the piston abruptly stops moving in the cylinder, there is a sudden pressure spike sensed by the switch that turns the pressure switch on. Controller 302 is programmed to monitor the state of the switch and to exit the auto-up control mode when the switch turns on—i.e. when the stabilizer is completely raised.

When the stabilizer is completely raised, controller 302 is programmed to enter idle mode 500 and await the operator's next command.

The final sub-mode of operating mode 404 is the Manual Control Without Auto-Up ("MCWAU") mode 508. We have so far described how controller 302 enters this mode, but have not described how it exits this mode or how it functions in this mode.

MCWAU mode 508 can be considered an "abort" mode. The system typically enters into this mode when the operator keeps moving the joystick after he has already commanded the auto-up mode to start. If he truly commanded the auto-up mode to start, he would immediately release the joystick and let the system perform its auto-up function. Since he has not done so, his continued movement may indicate he wishes to exit the auto-up mode and again take over manual control of the stabilizer with the joystick. It is with this thought in mind that the MCWAU mode was created.

In MCWAU mode 508, controller 302 is configured to respond just as it does in manual control mode 502 with one difference: the operator cannot directly re-enter the auto-up mode. Before he can reenter the auto-up modes he must first exit MCWAU mode 508 by releasing the joystick to its neutral position. Once he has done this, controller 302 leaves MCWAU mode 508 and returns to idle mode 500.

Controller 302 includes a flow rate damping or ramping feature that prevents abrupt and perhaps unintended motion of the stabilizers by the operator in modes 502 and 508.

When the operator moves the joystick in manual mode 502 or 508, controller 302 does not automatically and instantaneously change the duty cycle of the commanded pilot valve solenoid according to the up and down curves 602, 600 of the lookup table chart of FIG. 6. If the operator accidentally bumps the joystick, for example, and controller 302 did not have some sort of damping, the vehicle might suddenly lurch to one side of the other.

To prevent this from occurring, controller 302 is configured to change the duty cycle of the affected valve at a predetermined maximum rate of change. This damping functions generally as a low pass filter between the joystick and the pilot valve. Holding the joystick at a position indicated on the chart of FIG. 6 will indeed cause the duty cycle to change to the duty cycle corresponding to that duty cycle on curves 600, 602; it just will not reach that commanded duty cycle instantaneously.

This reduced response is also called a "ramp rate" and is expressed in terms of the maximum change in joystick voltage per unit time. For example, for the joystick having the voltage/duty cycle characteristics in FIG. 6, there are four preferred ramp rates that damp the system's response to sudden changes in joystick commands.

When commanding the stabilizer to rise, the maximum commanded increase in the rate of rise (i.e. transitioning from rising slow to rising fast) will be the rate that would increase the joystick signal from 2.65 volts to 4.0 volts in one second. With the automatic damping/ramp rate capability "on", this is the fastest the operator will be able to increase the rate of stabilizer rising. Referring to the lookup table of FIG. 6, this 2.65 to 4.0 volts per second maximum ramp rate is the same as one second to go from 35% to 72% duty cycle, or from 0% flow to a maximum flow, or from the stabilizer stationary to the stabilizer's maximum upward raising speed.

At the same time, however, operators occasionally do want the stabilizer to respond extremely quickly to rapid short fluctuations of the joystick. For example, operators often like to raise the stabilizer into the air, so they are free of obstructions and are not supporting the vehicle, then rapidly shake them up and down a few times in short oscillating strokes. Operators do this to shake excess dirt or mud off the stabilizer before raising it completely.

If controller 302 always damped the movement of the stabilizer by preventing rapid duty cycle changes, the operator would never be able to shake off the mud.

Controller 302 is therefore programmed to distinguish between what might be an inadvertent bump or twitch of the joystick and the rapid back-and-forth movement or oscillation that operators perform when shaking mud. Controller 302 is programmed to stop damping the calculated PWM signal applied to the up and down pilot valves whenever the operator makes a sufficient number of wide swings of the joystick.

Operators shake the stabilizer up and down by moving the joystick generally about the same central joystick position. The operator moves the joystick to an "up" position, then rapidly to a "down" position, back to an "up", then to "down", to "up", to "down", "up", "down", "up", "down", etc. This is significantly different than one or perhaps two inadvertent bumps of the joystick. Controller 302 takes advantage of this difference in movement in determining that the operator indeed is trying to shake the stabilizer.

As controller 302 reads each joystick command in succession, it examines them in accordance with the following pseudocoded instructions:

1. If joystick_command>upper_command_limit then shake_direction="up"
2. If joystick_command<lower command_limit then shake_direction="down"
3. If last_shake_direction is not equal to shake_direction then
4. Increment_shake_counter
5. Last_shake_direction=shake_direction
6. Reset_shake_timer
7. Endif
8. Increment_shake_timer
9. If shake_timer>max_shake_reversal_time then shake_count=0
10. If shake_count>max_shake_reverse_count then disable_valve_damping
11. Else enable_valve_damping The pseudocode in the above paragraph illustrates the programmed function of controller 302 as it determines whether to damp the PWM signal (i.e. apply a first ramp rate) or not to damp it (i.e. apply a second higher ramp rate) and permit the operator to shake the stabilizer. "joystick_command" refers to the command received from the stabilizer joystick 304 or 306. "upper_command_limit" refers to a predetermined upper value of the joystick signal (about 2.8 volts in the illustrated embodiment). "shake_direction" refers to a flag indicating the current direction of the operator's shaking (movement) of the joystick. "lower_command_limit" refers to a predetermined lower value of the joystick signal (about 2.2 volts in the illustrated embodiment). "last_shake_direction" refers to a flag indicating the direction of the last operator shaking of the joystick. "shake_timer" refers to a variable that is incremented in step 8. "max_shake_reversal_time" refers to a predetermined value to which the shake_timer value is compared in step 10.

In step 1, controller 302 determines whether the joystick command is greater than a certain minimum "up" joystick signal, preferably around 2.8 volts. If it is, controller 302 sets the shake direction to "up".

In step 2, controller 302 checks to see if the joystick command is below a certain maximum "down" joystick signal, preferably around 2.2 volts. If so, controller 302 sets the shake direction equal to "down".

In step 3, controller 302 checks to see if the shake direction has changed from "up" to "down" or from "down" to "up". This only happens when one joystick command is above 2.8 volts and the next joystick command is below 2.2 volts, or vice versa. Since controller 302 reads the joystick commands frequently, this would indicate that the joystick was flicked back and forth. In this example, that it was first pulled down below 2.2 volts and then rapidly moved up above 2.8 volts (or vice versa) in quick succession.

If controller 302 determines there has been such a rapid movement, controller 302 then counts this as an official shake by incrementing the shake counter in step 4, and sets the last shake direction equal to the current shake direction in step 5 so its doesn't double count the shake the next time through this loop. Controller 302 also resets the shake timer to zero in step 6.

In step 8, controller 302 increments the shake timer. This occurs every time the loop is executed since it is not inside the "if" structure of steps 3-7. The shake timer, which is reset whenever an up-down or down-up shake occurs, will be incremented or increased each time controller 302 executes this portion of its programming. It will keep incrementing the shake timer until it detects an operator shake of the joystick, at which time the shake timer is reset to zero (step 6). Thus, the larger the value of the shake timer variable, the longer the system has gone without an operator shake of the joystick.

In step 9 of the instructions, controller 302 compares the shake timer value with a predetermined value called max shake reversal time. This time is preferably around 600 milliseconds. If the shake timer exceeds this time, the controller 302 sets the shake count equal to zero.

In this step, controller 302 checks to see if too much time has passed since the last good shake the operator has given to the joystick. If he hasn't shaken it in a while, shake timer will gradually increment until it equals max shake reversal time, and the shake counter will be rest to zero. Controller 302 will begin again counting up from zero all the times the operator shakes the joystick vigorously back and forth.

In step 10, controller 302 compares shake count with max shake reverse count, a constant value, to see if shake count is greater. Remember that shake count is incremented each time controller 302 determines a vigorous shake has occurred. If shake count is greater than the constant max shake reverse count, then controller 302 disables valve damping. Max shake reverse count is preferably 2.

In effect, the foregoing program steps cause controller 302 to determine and count each vigorous up-and-down shake of the joystick by the operator. Once he has made a sufficient number of joystick shakes in a predetermined short period of time, controller 302 will respond by turning off the damping that would otherwise smooth out such rapid joystick movements.

A vigorous swing is one that moves the joystick back and forth at least from 2.8 to 2.2 volts or vice versa, passing through the neutral zone in each shake. This is a total shake distance of 0.6 volts, or about a ninth of the total zero to five volt range of the joystick. A sufficient number of shakes is two and the total time in which these shakes must occur is 600 milliseconds, or a speed of one shake every 300 milliseconds. The maximum total time may be preferably no more than 100 milliseconds per shake. Even more preferably it may be no more than 300 milliseconds per shake. Yet more preferably it may be no more than 800 milliseconds per shake.

The shake distance of 0.6 volts (0.3 volts above joystick neutral and 0.3 volts below joystick neutral) is equivalent to a 3 degree movement of the joystick in the up direction and 3 degree movement of the joystick in the down direction, where "degrees" refers to the angle of the joystick shaft. When the joystick moves over the shake distance, the free end of the joystick moves about 0.1 to 0.5 inches.

To the operator, his first two vigorous shakes of the joystick will appear to have no effect Controller 302 will substantially damp them out by applying the ramp rate. Once controller 302 determines (by the algorithm above) that the operator is trying to shake the stabilizer, it turns off the damping and the stabilizer will rapidly shake up and down as fast as the operator whips the joystick back and forth. When the operator slows down or stops moving the joystick back and forth from above 2.8 volts to below 2.2 volts (in this embodiment) controller 302 eventually resets the shake timer and the shake counter and enables the damping again, as provided in step 10.

The stabilizer shake mode starts automatically in response to the operator vigorously shaking the joystick back and forth from an "up" position to a "down" position, and continues until he stops vigorously shaking the joystick. It automatically reverts back to its typical damped mode of operation.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims.

For example, although a single controller is illustrated herein as controlling the operation of the stabilizers, there may be more than one controller.

While the controller is preferably based on a digital microprocessor or microcontroller, the controller may nonetheless be embodied in discrete logic digital and analog components.

While the circuit illustrates includes two electrically driven pilot hydraulic valves coupled to a single valve that drives each stabilizer up and down, all the functions could be provided in a single valve. The pilot valves could be deleted and the signals generated by the controller applied directly to a single valve coupled to the cylinder. Rather than a single valve coupled to the cylinder, two valves, one for retract and one for the extend function could be provided instead. Further, a pilot valve could be coupled to either of the two valves coupled to the ports to drive each one individually, providing four valves for moving each stabilizer up and down.

While the system shows two joysticks as the proportional control operator input device, a single joystick could be used with a left stabilizer/right stabilizer selector device.

The joysticks could be replaced with knobs, dials or levers, and the Hall Effect device could be replaced with a shaft encoder or other digital device; or a potentiometer, variable resistor or other analog output device.

Rather than being connected directly to the controller as shown, the operator input devices (i.e. the stabilizer joysticks) could have their own controller with which they communicate, which could in turn transmit their joystick position signals to a second controller or controllers configured to actually control the stabilizers as described herein. This controller-to-controller communication can be provided by a serial communications bus using wires or optical conduits to transmit joystick position signals. It might be analog, but would more preferably be a digital communications scheme, such as packetized communication over a CAN bus wherein the packets are digital representations of the joysticks' positions.

We claim:

1. A system for automatically raising a stabilizer of a work vehicle, comprising a proportional control operator input device configured to signal both a plurality of upward stabilizer raising rates and a plurality of stabilizer lowering rates;

at least one electronic controller configured to receive a signal indicating a commanded raising rate and a commanded lowering rate from the input device; and at least one hydraulic valve coupled to the controller to raise and lower the stabilizer in response to rate signals received from the controller;

wherein:

the controller has a first mode of operation in which it signals the at least one valve to raise and lower the stabilizer proportionate to the position of the input device; the controller has a second mode of operation in which it automatically raises the stabilizer to a predetermined higher up position; and the controller is configured to change from the first mode of operation to the second mode of operation based upon the operator's positioning and holding the input device in a single position of a range of positions for a period of time.

2. The system of claim 1, wherein the controller is configured to exit the second mode of operation when the stabilizer reaches the predetermined higher up position.

3. The system of claim 2, wherein the predetermined higher up position is indicated by a hydraulic pressure spike.

4. The system of claim 3, wherein the controller is configured to monitor a sensor responsive to the hydraulic pressure spike.

5. The system of claim 2, wherein the controller is configured to leave the second mode of operation at least after a predetermined period of time by closing the at least one valve.

6. The system of claim 1, wherein the controller is configured to leave the second mode of operation at least when the operator does not release the input device.

7. A system for automatically raising a stabilizer of a work vehicle, comprising:

an input device configured to generate signals indicating a plurality of stabilizer rates of movement;

an electronic controller configured to receive the signals from the input device and generate corresponding valve signals; and at least one hydraulic valve coupled to the controller to move the stabilizer in response to the valve signals;

wherein:

the controller has a first mode of operation in which it is configured to signal the at least one hydraulic valve to raise and lower the stabilizer proportionate to the input device position;

the controller has a second mode of operation in which it automatically raises the stabilizer to a predetermined upper position; and the controller is configured to change from the first mode of operation to the second mode of operation based upon the operator's positioning and holding the input device in a single position of a range of positions for a period of time.

8. The system of claim 7, wherein the controller is configured to exit the second mode of operation when the stabilizer reaches the predetermined upper position.

9. The system of claim 8, wherein the controller determines the predetermined upper position by sensing a hydraulic pressure spike.

10. The system of claim 9, wherein the controller is configured to monitor a sensor responsive to the hydraulic pressure spike.

11. The system of claim 8, wherein the controller is configured to leave the second mode of operation at least after a predetermined period of time by closing the at least one valve.

12. The system of claim 7, wherein the controller is configured to leave the second mode of operation at least when the operator does not release the input device.

13. The system of claim 7, further comprising:

a second input device configured to generate second signals indicating a plurality of stabilizer rates of movement for a second stabilizer;

wherein the controller is configured to receive the second signals from the second input device and generate corresponding second valve signals; and at least a second hydraulic valve coupled to the controller to move the second stabilizer in response to the second valve signals;

wherein the controller is further configured to control the stabilizer and the second stabilizer independently of one another in both the first and second modes of operation.

14. The system of claim 7, wherein the controller is configured to damp stabilizer movement in the first mode of operation, and further wherein the controller is configured to enter a third, less damped, proportional control mode of operation.

* * * * *